US007028964B2

(12) United States Patent
Baechle

(10) Patent No.: US 7,028,964 B2
(45) Date of Patent: Apr. 18, 2006

(54) TUBULAR STRUCTURE FOR SUPPORTING A PRODUCT

(75) Inventor: James Baechle, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 26 days.

(21) Appl. No.: 10/707,035

(22) Filed: Nov. 17, 2003

(65) Prior Publication Data

US 2005/0103964 A1 May 19, 2005

(51) Int. Cl.
*A47B 91/00* (2006.01)

(52) U.S. Cl. ..... 248/346.01; 248/673; 248/678; 248/346.02; 248/346.3; 206/320

(58) Field of Classification Search ..... 248/672, 248/673, 678, 680, 188.1, 188.2, 346.5, 346.01, 248/346.02, 346.05, 346.3, 346.4; 312/351.1, 312/351.2; 206/320, 586; 52/210, 668, 52/506.07, 506.08; 40/780; 108/51.3, 51.11, 108/53.1, 53.3, 55.1, 56.1, 56.3
See application file for complete search history.

(56) References Cited

U.S. PATENT DOCUMENTS

| | | | | |
|---|---|---|---|---|
| 2,094,381 | A * | 9/1937 | Slayter | 52/786.13 |
| 2,185,904 | A * | 1/1940 | Stowe | 72/331 |
| 2,194,669 | A * | 3/1940 | Mumford | 206/454 |
| 3,097,684 | A * | 7/1963 | Le Tarte | 72/339 |
| 3,648,959 | A | 3/1972 | Wagner | |
| 3,649,398 | A * | 3/1972 | Keith | 156/79 |
| 3,659,534 | A | 5/1972 | Childs | |
| 3,881,794 | A * | 5/1975 | Henning | 312/259 |
| 4,279,204 | A * | 7/1981 | Propst | 108/53.3 |
| 4,399,972 | A | 8/1983 | McCulloch | |
| 4,482,054 | A | 11/1984 | Gardner | |
| 4,483,444 | A | 11/1984 | Gardner | |
| 4,759,295 | A | 7/1988 | Nilsen et al. | |
| 4,863,024 | A | 9/1989 | Booth | |
| 5,018,263 | A * | 5/1991 | Stern | 29/469.5 |
| 5,031,776 | A * | 7/1991 | Morgan, IV | 206/600 |
| 5,152,594 | A * | 10/1992 | Ashley | 312/270.1 |
| 5,218,913 | A | 6/1993 | Winebarger et al. | |
| 5,440,998 | A * | 8/1995 | Morgan et al. | 108/57.18 |
| 5,473,995 | A * | 12/1995 | Gottlieb | 108/51.3 |
| 5,579,700 | A * | 12/1996 | Nuechterlein et al. | 108/55.1 |
| 5,704,488 | A * | 1/1998 | Smith | 206/598 |
| 5,881,525 | A * | 3/1999 | Riegelman et al. | 52/656.7 |
| 5,913,501 | A * | 6/1999 | Heuss et al. | 248/346.07 |
| 5,950,546 | A * | 9/1999 | Brown et al. | 108/56.1 |
| 6,155,527 | A | 12/2000 | Muyskens | |
| 6,192,807 | B1 * | 2/2001 | Mason | 108/51.11 |
| 6,681,833 | B1 * | 1/2004 | Wylie | 160/381 |

* cited by examiner

*Primary Examiner*—Korie Chan
(74) *Attorney, Agent, or Firm*—Clausen Miller, P.C.

(57) ABSTRACT

A base pad for supporting and cushioning a product such as a major home appliance. The base pad is made from a tube formed into a desired cross-sectional shape (profile) and folded into a square or rectangular frame-like configuration. V-shaped sections are cut out of the tube to facilitate the folding. The tube may have pockets located at the corners to hold vertical support posts.

9 Claims, 3 Drawing Sheets

TUBULAR STRUCTURE FOR SUPPORTING A PRODUCT

BACKGROUND OF INVENTION

This patent relates to base pads for supporting products such as major home appliances. More specifically, this patent relates to a base pad for supporting a major home appliance in which the base pad is formed from a formed paper or plastic tube that has been folded into a rectangular frame.

Protecting major household appliances from shock and vibration during manufacture, shipping, storage and display is a constant challenge for appliance manufacturers. Numerous protective bases have been tried, including traditional wooden pallets, paper honeycomb base pads such as that disclosed in U.S. Pat. No. 3,934,805; molded plastic skids such as that disclosed in U.S. Pat. Nos. 4,146,205 and 4,183,491; corrugated pads (U.S. Pat. No. 4,390,154); and composite structures made from multiple materials such as wood and polystyrene (U.S. Pat. No. 4,241,892), wood and corrugated board (U.S. Pat. Nos. 4,863,024 and 5,996,510), cardboard and polystyrene (U.S. Pat. No. 4,610,355), paperboard and polystyrene (Muyskens U.S. Pat. No. 6,155,527), and paperboard, polystyrene and corrugated (Muyskens U.S. Pat. No. 6,264,157). Some of these base pads have low recycle ability, while others have limited cushioning effectiveness, low strength, or susceptibility to certain environmental conditions such as exposure to water.

Thus it is an object of the present invention to provide an appliance base that is strong yet can be easily recycled.

Another object of the invention is to provide a base pad design that can be easily modified to accommodate various product sizes and weights.

Further and additional objects will appear from the description, accompanying drawings, and appended claims.

SUMMARY OF INVENTION

The present invention is a base pad for supporting a product, the base pad comprising an elongated hollow tubular member having, in a preferred (rectangular) embodiment, four segments connected along three fold lines, the tubular member being folded along the fold lines into a four-cornered rectangular frame having a product supporting surface. Preferably, the base pad has pockets at each corner for receiving vertical stacking and cushioning posts and apertures disposed in the product supporting surface for receiving the product feet. To make the corner post pockets, portions of the top section of the tubular member are cut away or otherwise removed.

Prior to folding, the tubular member is linear and comprises four segments separated by three substantially V-shaped cut out sections with a fold line being located at the apex of each cutout section.

The tubular member may be thought of as having outer and inner walls joined at their ends to define a hollow space therebetween. The outer wall comprises a horizontal (bottom) section and a vertical (outer perimeter) section joined at a right angle to define an outer apex. The inner wall comprises a first vertical section joined at a right angle to the product support surface to define an inner corner adjacent the product. A top section extends from the first vertical section to the outer wall vertical section to form the top surface of the base pad.

In one embodiment, the outer wall bottom surface has an integrally formed bead extending upward toward the product support surface for added strength.

The base pad may be constructed in the following manner: forming or extruding a tube into a desired cross-sectional shape, cutting V-shaped sections out of the tube, and folding the tube at the cut out sections and bringing the opposite ends together. The ends of the tube that form one of the corners may be affixed to each other.

DETAILED DESCRIPTION

Figure 1:
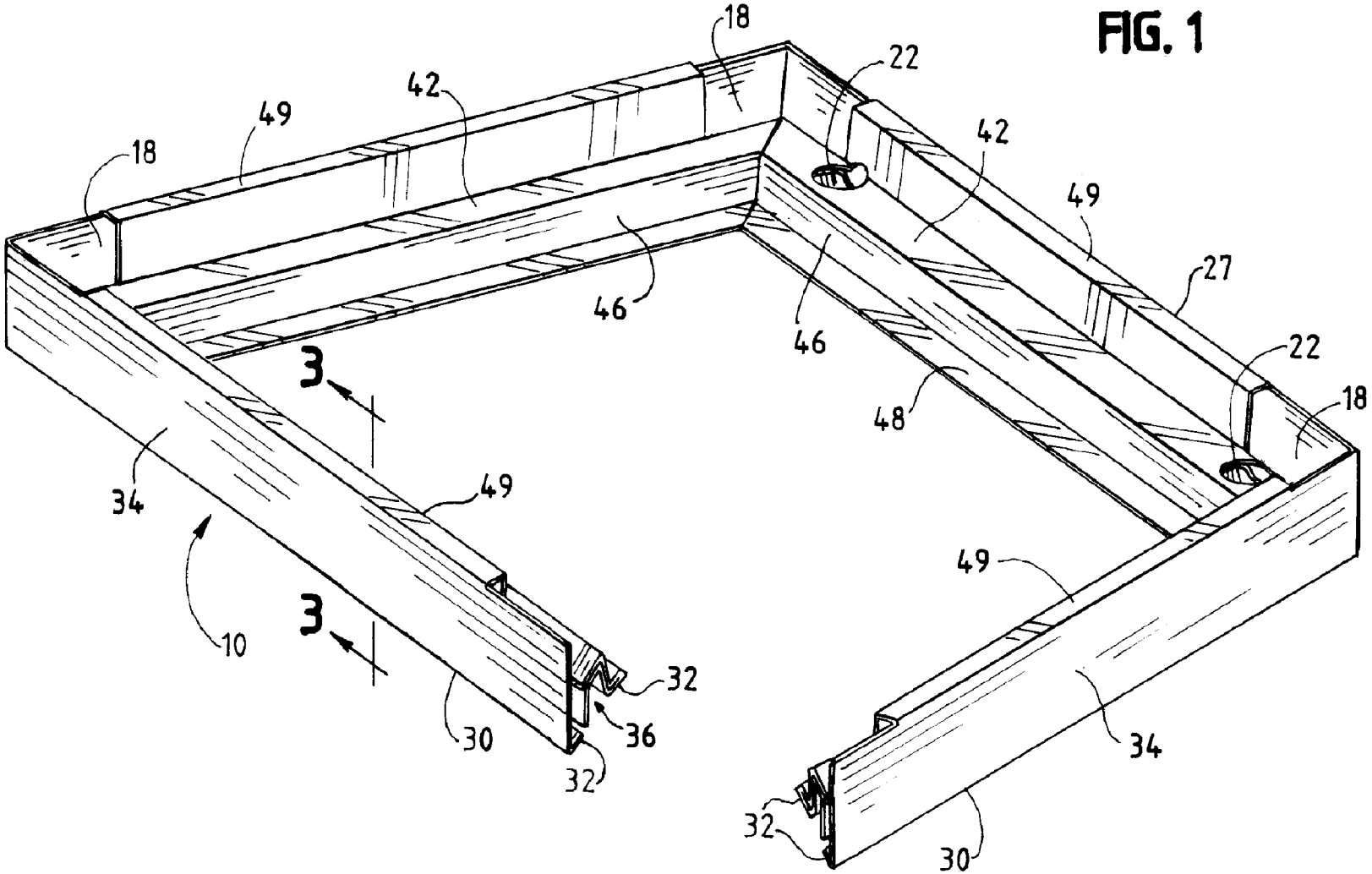
FIG. 1 is a perspective view of a partially assembled base pad according to the present invention.

Turning to the drawings, there is shown in FIG. 1 one embodiment of the present invention, a (partially assembled) base pad 10 for supporting and cushioning a product such as a major home appliance. The base pad 10 is made from a tube 11 that has been formed or extruded into a desired cross-sectional shape (profile) and folded into a square or rectangular frame-like configuration having four mitered corners. The tube preferably is made from paperboard but can also be made from extruded plastic or any other suitable material. V-shaped sections 12 cut out of the tube 11 and fold lines located at the apex of each cut out section 12 facilitate the folding. The product rests on a product support surface or ledge 42 formed in the tube 11. Openings or pockets 18 may be cut out of each corner to receive the bottom ends of vertical cushioning posts (not shown). Holes 22 may be cut in the product supporting surface 42 of the tube 11 to accommodate feet protruding from the bottom of the product and to help position the product on the base pad 10. When the product is resting on the pad 10, the feet may protrude into the hollow interior space of the pad 10.

Figure 2:
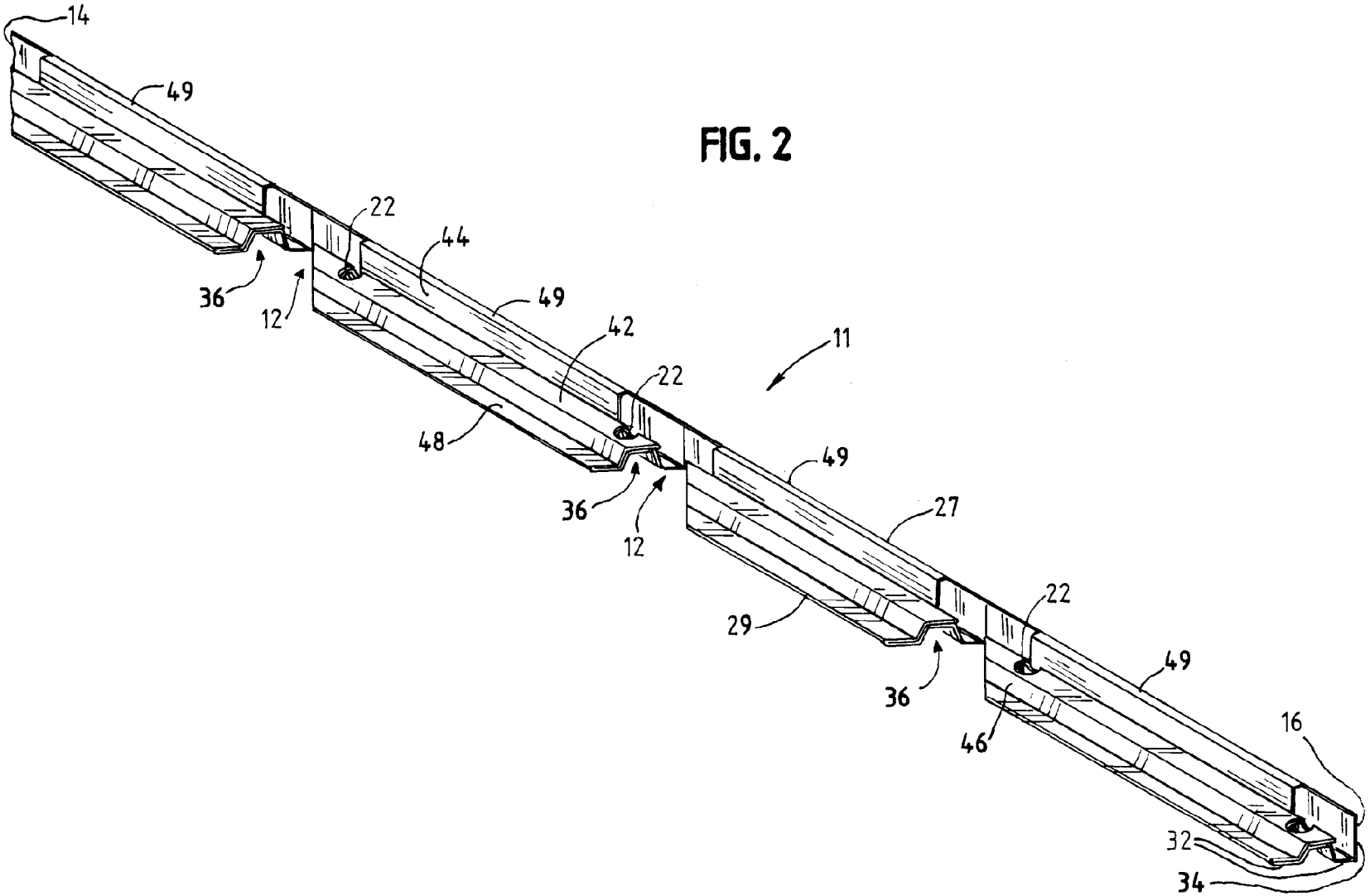
FIG. 2 is a perspective view of a formed and cut tubular post prior to being folded into the base pad of FIG. 1.

FIG. 2 is a perspective view of a tube 11 after it has been formed and cut but prior to being folded into the base pad 10 of FIG. 1. Preferably, the tube 11 is of the type manufactured by Sonoco Products Company of Hartsville, S.C. and described in Muyskens U.S. Pat. No. 6,247,596, incorporated herein by reference. Such tubes have been used with great success as vertical and horizontal support posts to provide protection and cushioning to packaged products.

The tube 11 is cut so that its length is equal to the desired perimeter dimension of the base pad 10. Three V-shaped sections 12 are cut out of the tube 11 at spaced intervals and will become three of the four mitered corners of the base pad 10 when the tube 11 is folded along its outer wall vertical section 34. The angle formed by each V-shaped cut out 12 is equal to or slightly less than ninety degrees. The fourth corner of the base pad 10 is formed when the ends 14, 16 of the tube 11 are brought together. Consequently, the angles formed by each end 14, 16 and a plane normal to the longitudinal axis of the tube 11 are complimentary, that is, their sum is also equal to or slightly less than ninety degrees.

The base pad is formed by folding the tube 11 at the V-shaped cut-out sections 12 and bringing the opposite ends 14, 16 together to form a four-cornered rectangular frame on which the product rests. The opposite ends 14, 16 may be joined together in some fashion, such as with adhesive, tape, staples or interlocking structures.

Figure 3:
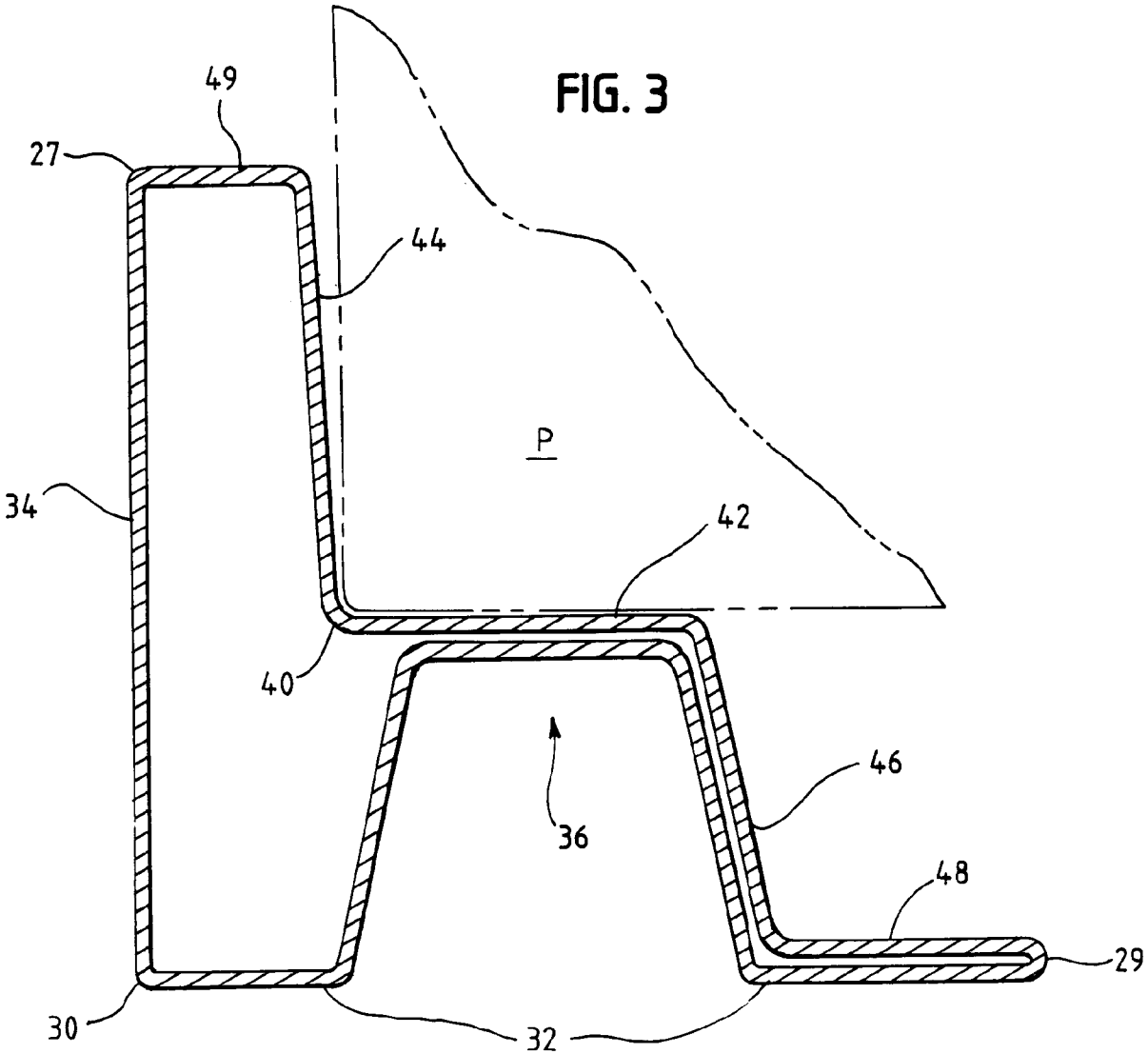
FIG. 3 is a cross-sectional view of the base pad of FIG. 1 taken along line 3—3.

FIG. 3 is a cross-sectional view of the base pad 10 of FIG. 1, taken along line 3—3. The tubular structure may be thought of as comprising an inner, product facing wall and an outer wall (away from the product) joined at opposing ends 27, 29 and defining a hollow space therebetween. The outer wall comprises a substantially horizontal, bottom section 32 and a vertical section 34 extending at a right angle to each other from an outer apex 30. The outer wall vertical section 34 may be scored or creased to create fold lines to facilitate folding the tube 11. The horizontal section 32 forms the bottom of the base pad 10 and may comprise an upwardly extending bead 36. The bead 36 may abut the product support surface 42 and adds strength and stiffness to the tubular structure.

The inner wall comprises the product support surface or ledge 42 and a first vertical section 44 extending at a right angle to each other from an inner corner 40. A second vertical section 46 extends downward from the ledge 42 until it abuts the outer wall horizontal section 32. A second horizontal section 48 extends horizontally from the second vertical section 46 to end 29. A top rim or section 49 extends at substantially a right angle from the first vertical section 44 to end 27.

As shown in FIG. 2, the holes 22 for the product feet are cut out of or otherwise formed in the product supporting surface or ledge 42. Preferably, the holes 22 are made near opposing ends of the tube segments that form the sides of the base 10. The vertical support post pockets 18 are made by cutting out portions of the upper wall first vertical section 44 and the top rim 49 near each corner.

The cross-sectional profile of the base pad 10 can be varied to provide different levels of structural support and cushioning for a variety of product sizes and weights. For example, removing the bead 36 from the lower wall horizontal section 32 decreases the structural stiffness of the base pad 10.

The base pad can be made according to the following steps: (i) forming a paper or plastic tube 11 into a desired cross-sectional shape; (ii) cutting V-shaped sections 12 out of the tube 11 to create cut out areas at positions along the tube corresponding to the corner of the base pad, and cutting the ends of the tube to form complementary angles; (iii) cutting pockets 18 out of the tube 11 at each corner to accommodate vertical support posts; (iv) cutting holes 22 in the tube 11 to accommodate downwardly projecting feet; (v) scoring or creasing the outer wall vertical surface 34 at the apex of each V-shaped cut out section 12 to form fold lines; and (vi) folding the tube along the fold lines and bringing the opposite ends 14, 16 together to form a four-cornered rectangular base pad 10.

Thus there has been provided a rectangular base pad formed from a tube for supporting and cushioning a product. Because the base pad is made from paper or plastic it is readily recyclable. And because the tube from which the base pad is made can be constructed in different lengths and shapes, the present invention can be used to support and cushion a variety of products.

Although the invention has been described with respect to a rectangular base pad 10, it should be understood that the invention may be used to form non-rectangular base pads as well. Thus, a base pad having "n" sides may be formed from a formed paper or plastic tube having "n" segments separated by (n−1) substantially V-shaped cut out sections with a fold line located at the apex of each cut out section. For a base pad having equal sides, the angle formed by each V-shaped cut out section should be equal to or slightly less than (360/n) degrees. If the sides are of unequal length the angle formed by the V-shaped cut out sections may vary from section to section.

Still other modifications and alternative embodiments of the invention are contemplated which do not depart from the scope of the invention as defined by the foregoing teachings and appended claims. It is intended that the claims cover all such modifications that fall within their scope.

The invention claimed is:

1. A base pad for supporting a product, the base pad comprising a linear, elongated hollow tubular member having a plurality of segments joined at their ends along fold lines, the tubular member being folded along the fold lines to form a polygonal frame having corners such that each segment becomes a side of the polygonal frame, the segments comprising:

a first horizontal section forming the bottom of the base pad;

an outer vertical section extending upward at a right angle from the first horizontal section, the juncture of the first horizontal section and the outer vertical section defining an outer apex;

a second vertical section extending upward from the first horizontal section distant the outer apex;

a product supporting surface extending horizontally from the second vertical section toward the outer vertical section;

a first vertical section extending upward from the product supporting surface; and a top section extending from the first vertical section to the outer vertical section;

wherein the fold lines are formed in the outer vertical section, and wherein portions of the first vertical section and the top section at either end of each segment adjacent the corners are cut out to define pockets to accommodate vertical stacking and cushioning posts.

2. The base pad of claim 1 further comprising holes disposed in the product supporting surface and configured for receiving product feet.

3. The base pad of claim 1 wherein the first horizontal section has an integrally formed bead extending upward toward the product support surface.

4. The base pad of claim 3 wherein the bead has opposing sides and an apex that abuts the product support surface.

5. The base pad of claim 1 wherein the linear, elongated hollow tubular member is formed from wound paperboard.

6. The base pad of claim 1 wherein the linear, elongated hollow tubular member is fanned from extruded plastic.

7. The base pad of claim 1 further comprising a second horizontal section extending horizontally from a distal end of the first horizontal section distant from the outer apex to the second vertical section.

8. The base pad of claim 1 wherein the polygonal frame has four sides.

9. The base pad of claim 1 wherein the linear, elongated hollow tubular member has opposing ends which, when the tubular member is folded into the polygonal frame, are joined together.

* * * * *

UNITED STATES PATENT AND TRADEMARK OFFICE

CERTIFICATE OF CORRECTION

PATENT NO. : 7,028,964 B2
APPLICATION NO. : 10/707035
DATED : April 18, 2006
INVENTOR(S) : Baechle It is certified that error appears in the above-identified patent and that said Letters Patent is hereby corrected as shown below:

Column 4, line 51: Delete “fanned” and replace with --formed--.

Signed and Sealed this

Eighth Day of August, 2006

JON W. DUDAS
*Director of the United States Patent and Trademark Office*